US010286657B2

(12) United States Patent
Kameshima et al.

(10) Patent No.: US 10,286,657 B2
(45) Date of Patent: May 14, 2019

(54) INKJET PRINTING APPARATUS AND RECOVERY PROCESSING METHOD

(71) Applicant: CANON KABUSHIKI KAISHA, Tokyo (JP)

(72) Inventors: Rinako Kameshima, Tachikawa (JP); Minoru Teshigawara, Saitama (JP); Takatoshi Nakano, Yokohama (JP); Atsushi Takahashi, Tama (JP); Takuya Fukasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/649,789

(22) Filed: Jul. 14, 2017

(65) Prior Publication Data

US 2018/0022086 A1 Jan. 25, 2018

(30) Foreign Application Priority Data

Jul. 20, 2016 (JP) ..... 2016-142526

(51) Int. Cl.
*B41J 2/045* (2006.01)
*B41J 2/165* (2006.01)

(52) U.S. Cl.
CPC ..... *B41J 2/0458* (2013.01); *B41J 2/04505* (2013.01); *B41J 2/04563* (2013.01); *B41J 2/04566* (2013.01); *B41J 2/16508* (2013.01); *B41J 2/16526* (2013.01); *B41J 2/16585* (2013.01); *B41J 2/04593* (2013.01); *B41J 2/04595* (2013.01)

(58) Field of Classification Search
CPC .. B41J 2/16526; B41J 2/17566; B41J 2/0456; B41J 2/04566; B41J 2002/17569
See application file for complete search history.

(56) References Cited

U.S. PATENT DOCUMENTS 6,561,622 B1 * 5/2003 Suzuki ..... B41J 2/16526 347/23
6,623,093 B2 9/2003 Takahashi et al.
6,984,009 B2 1/2006 Nakagawa et al.
6,994,416 B2 2/2006 Seki et al.
7,011,386 B2 3/2006 Iwasaki et al.
7,114,795 B2 10/2006 Shimura et al.
7,374,267 B2 5/2008 Oshio et al.
7,396,095 B2 7/2008 Nakagawa et al.
7,399,046 B2 7/2008 Teshigawara et al.
7,448,721 B2 11/2008 Oshio et al.
7,465,006 B2 12/2008 Edamura et al.
(Continued)

FOREIGN PATENT DOCUMENTS

JP 2007-320250 A 12/2007

OTHER PUBLICATIONS

Copending, unpublished U.S. Appl. No. 15/623,833, filed Jun. 15, 2017.

*Primary Examiner* — John Zimmermann
(74) *Attorney, Agent, or Firm* — Venable LLP

(57) ABSTRACT

Provided are an inkjet printing apparatus and a recovery processing method which can suppress occurrence of defective ejection and can suppress an ink consumption amount. For that purpose, information relating to a condensation degree of ink is obtained, and ejection operation is made in accordance with the obtained condensation degree of ink.

13 Claims, 11 Drawing Sheets

(56) References Cited

U.S. PATENT DOCUMENTS

| | | | | |
|---|---|---|---|---|
| 8,136,909 | B2 * | 3/2012 | Ogasawara | B41J 29/377 347/17 |
| 8,317,290 | B2 | 11/2012 | Edamura et al. | |
| 8,752,930 | B2 | 6/2014 | Doi et al. | |
| 8,851,618 | B2 | 10/2014 | Teshigawara et al. | |
| 9,387,679 | B2 | 7/2016 | Shiiba et al. | |
| 9,517,628 | B2 | 12/2016 | Tenkawa et al. | |
| 2006/0087539 | A1 * | 4/2006 | Loyd | B41J 2/195 347/89 |
| 2008/0079759 | A1 * | 4/2008 | Nagashima | B41J 2/175 347/10 |
| 2013/0100200 | A1 | 4/2013 | Hamasaki et al. | |
| 2016/0052278 | A1 | 2/2016 | Iwasaki et al. | |

* cited by examiner

| Pv TABLE | | NUMBER OF DEPOSITION PREVENTING TIMES Pf/Ps | |
|---|---|---|---|
| | | Pvf | Pvs |
| INK CONDENSATION DEGREE Vn | $V_0$ | $P_{0f}$ | $P_{0s}$ |
| | $V_1$ | $P_{1f}$ | $P_{1s}$ |
| | $V_2$ | $P_{2f}$ | $P_{2s}$ |
| | $V_3$ | $P_{3f}$ | $P_{3s}$ |
| | $V_4$ | $P_{4f}$ | $P_{4s}$ |
| | ... | | |
| | $V_{n-1}$ | $P_{n-1f}$ | $P_{n-1s}$ |
| | $V_n$ | $P_{nf}$ | $P_{ns}$ |

FIG.8

| Csv TABLE | | NUMBER OF EJECTION OPERATION TIMES Sn | | | | | | | |
|---|---|---|---|---|---|---|---|---|---|
| | | $S_0$ | $S_1$ | $S_2$ | $S_3$ | $S_4$ | ... | $S_{n-1}$ | $S_n$ |
| INK CONDENSATION DEGREE Vn | $V_0$ | $C_{00}$ | $C_{10}$ | $C_{20}$ | $C_{30}$ | $C_{40}$ | | $C_{n-10}$ | $C_{n0}$ |
| | $V_1$ | $C_{01}$ | $C_{11}$ | $C_{21}$ | $C_{31}$ | $C_{41}$ | | $C_{n-11}$ | $C_{n1}$ |
| | $V_2$ | $C_{02}$ | $C_{12}$ | $C_{22}$ | $C_{32}$ | $C_{42}$ | | $C_{n-12}$ | $C_{n2}$ |
| | $V_3$ | $C_{03}$ | $C_{13}$ | $C_{23}$ | $C_{33}$ | $C_{43}$ | | $C_{n-13}$ | $C_{n3}$ |
| | $V_4$ | $C_{04}$ | $C_{14}$ | $C_{24}$ | $C_{34}$ | $C_{44}$ | | $C_{n-14}$ | $C_{n4}$ |
| | ... | | | | | | | | |
| | $V_{n-1}$ | $C_{0n-1}$ | $C_{1n-1}$ | $C_{2n-1}$ | $C_{3n-1}$ | $C_{4n-1}$ | | $C_{n-1n-1}$ | $C_{nn-1}$ |
| | $V_n$ | $C_{0n}$ | $C_{1n}$ | $C_{2n}$ | $C_{3n}$ | $C_{4n}$ | | $C_{n-1n}$ | $C_{nn}$ |

FIG.10

INKJET PRINTING APPARATUS AND RECOVERY PROCESSING METHOD

BACKGROUND OF THE INVENTION

Field of the Invention

The present invention relates to an inkjet printing apparatus and a recovery processing method.

Description of the Related Art

In the inkjet printing apparatus, an image is printed on a printing medium by ejection of an ink from an ejection port while a print head is moving. In such an inkjet printing apparatus, so-called recovery processing is executed to remove ink which has been thickened by evaporation of moisture in the ink from the ejection port and to supply a new ink. The specific recovery processing includes an ejection operation of discharging the thickened ink by ejecting an ink to an absorber in a cap from the ejection port.

However, in a case where ejection operation is continuously performed onto the absorber in the cap in the inkjet printing apparatus with an ink having low solubility, there is a concern that an ink is deposited on the absorber, and defective ejection caused by contact with an ejection port forming surface of the print head occurs. Thus, Japanese Patent Laid-Open No. 2007-320250 discloses a method of dissolving a deposited ink by ejecting an ink which is hard to be deposited after ejection of an ink with low solubility.

However, ease of deposition of ink or ease of dissolving of a deposited ink differs depending on a condensation degree of the ink even in the same ink. The higher the condensation degree is, the more easily the ink is deposited, and the deposited ink is hard to be dissolved. Therefore, even in a case where the deposited ink is to be dissolved by the method in Japanese Patent Laid-Open No. 2007-320250 without considering the condensation degree, ejection of the ink which is hard to be deposited to a deposition of the condensed ink under a condition in which the deposited uncondensed ink can be dissolved cannot solve the deposition. Alternatively, in a case where the ink hard to be deposited is ejected to the deposition of the uncondensed ink under a condition in which the deposited condensed ink can be dissolved, extra ink is consumed.

Thus, in order to give priority to a product quality, also considered is a method of dissolving the deposition by ejection operation under a condition with the largest ejection amount. However, in that case, the ejection operation in an amount which can dissolve the deposition of the most condensed ink is performed even in a case where the deposition is the uncondensed ink, which increases an ink consumption amount.

SUMMARY OF THE INVENTION

Therefore, the present invention provides an inkjet printing apparatus and a recovery processing method which can suppress occurrence of defective ejection and can suppress an ink consumption amount.

An inkjet printing apparatus of the present invention for that purpose includes a print head configured to perform printing by ejecting an ink from an ejection port; an ink receiving unit configured to receive an ink ejected from the print head; a control unit configured to cause the print head to perform ejection operation to the ink receiving unit; and an obtaining unit configured to obtain information relating to a condensation degree of ink, wherein the control unit causes the print head to perform the ejection operation based on the information relating to a condensation degree of ink obtained by the obtaining unit.

According to the present invention, realized are an inkjet printing apparatus and a recovery processing method which can suppress occurrence of defective ejection and can suppress wasteful ink consumption.

Further features of the present invention will become apparent from the following description of exemplary embodiments with reference to the attached drawings.

BRIEF DESCRIPTION OF THE DRAWINGS

FIG. 8 is a view illustrating a Pv table used in a case where the number of ejection operation times is determined;

FIG. 10 is a view illustrating a Csv table used in a case where an ink deposited amount is counted.

DESCRIPTION OF THE EMBODIMENTS

First Embodiment

Figure 1:
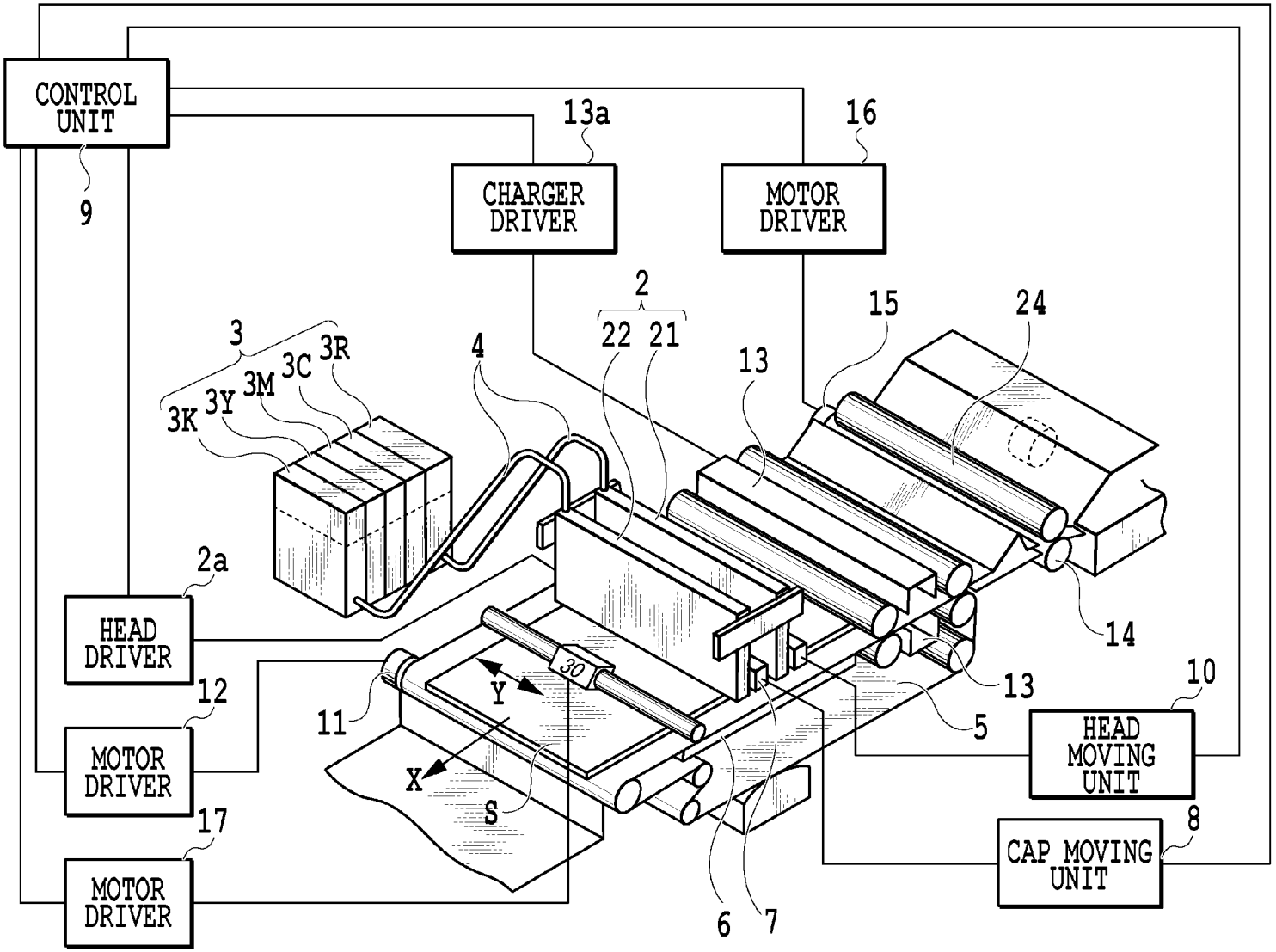
FIG. 1 is a schematic view illustrating an outline constitution of an inkjet printing apparatus.

A first embodiment of the present invention will be described below by referring to the drawings.

Note that, in this Description, this embodiment is described by using a full-line head constitution in which a plurality of chips is disposed in a length of a width of a printing medium, and printing is performed by one scanning (one pass) to the printing medium, but such a constitution is not necessarily limiting. For example, it is only necessary to have a constitution in which the print head and the printing medium relatively move, and the constitution is not particularly limited.

Moreover, in this Description, the explanation will be made by assuming a case in which an ink is deposited on an absorber in a cap, but the present invention may be applied not only onto the absorber in the cap but also to a spot with a concern that the ink is preliminarily ejected and deposited, such as on a platen to which the ink is ejected during marginless printing, for example.

FIG. 1 is a schematic view illustrating an outline constitution of an inkjet printing apparatus 1 according to this embodiment. The printing apparatus 1 includes a print head 2 which ejects a color-material ink. The print head 2 is a so-called full-line type in which a plurality of ejection ports is disposed in a range corresponding to a width of a printing medium. The print head 2 is arranged so as to extend in a direction (ejection port arrangement direction: arrow Y direction) orthogonal to a conveyance direction (arrow X direction) of the printing medium S. Moreover, the print head 2 is provided at a position facing a platen 6 with a conveyance belt 5 between them and is elevated up/down in a direction facing the platen 6 by a head moving unit (also referred to as a head holder or a carriage) 10. This head moving unit 10 has its operation controlled by a control unit 9.

Moreover, in the print head 2, ejection ports for ejecting ink, a common liquid chamber to which ink in an ink tank 3 is supplied, and an ink channel for leading the ink to each of the ejection ports from this common liquid chamber are provided. In the vicinity of each of the ejection ports, for example, a heat generating resistance element (heater) for generating air bubbles in the ink is provided, and by driving the heater by a head driver, the ink is ejected from each of the ejection ports. The heater in the vicinity of each of the ejection ports is electrically connected to the control unit 9 through a head driver 2*a*, and driving of the heater is controlled in accordance with an on/off signal (ejection/non-ejection signal) from the control unit 9.

The print head 2 is connected to four ink tanks 3C, 3M, 3Y, and 3K (they are collectively called the ink tank 3) storing a cyan (C) ink, a magenta (M) ink, a yellow (Y) ink, and a black (K) ink, respectively through a connection pipeline 4. Moreover, each of the ink tanks 3 can be detachably attached individually. In this Description, the explanation will be made for a printer using inks in four colors of KCMY, but the present invention is not limited to these ink colors and the number of types. That is, there may be a form using one type of ink, such as black (K), or a form using a large number of inks, such as pale cyan, pale magenta, pale gray, red, and green.

Figure 4:
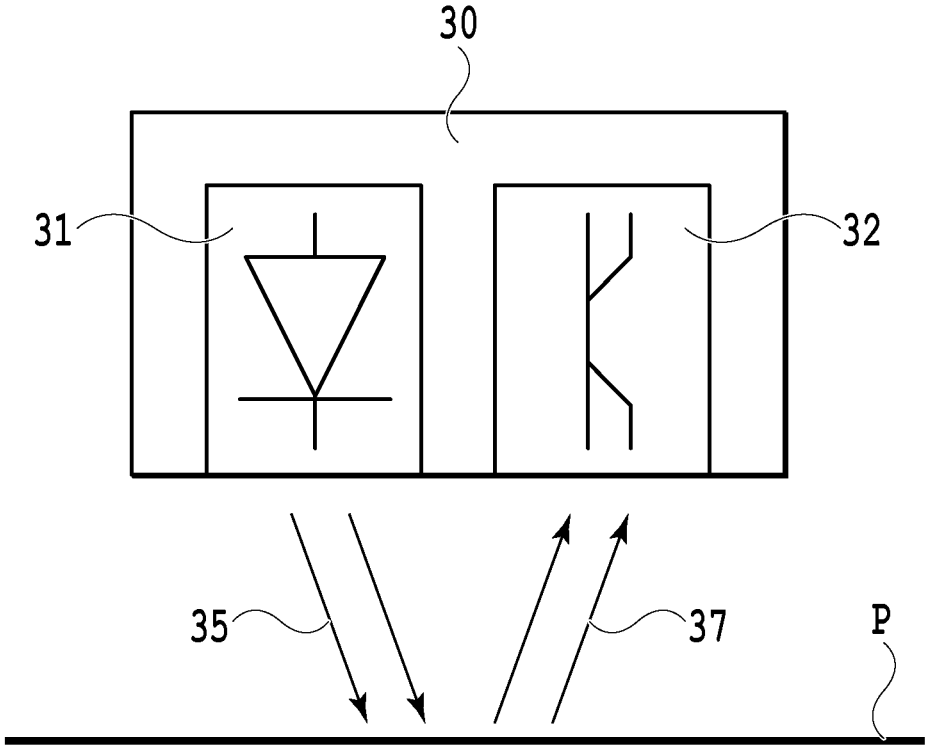
FIG. 4 is a schematic view illustrating a reflection-type optical sensor.

The control unit 9 integrally controls various types of processing in the printing apparatus 1. The control unit 9 is constituted by a CPU 43, and memory, such as a ROM 44 and a RAM 45, and ASIC, for example. On a side of the print head 2, a cap unit 7 is arranged in a state shifted by a half pitch with respect to an arrangement interval of the print head 2. Then, a cap moving unit 8 whose operation is controlled by the control unit 9 can move the cap unit 7 between a position on the side of the print head 2 and a position immediately below, whereby recovery processing such as capping on the print head 2 or ejection operation can be executed. Here, the ejection operation is the recovery processing for recovering an ejection state by ejecting the ink not contributing to printing into a cap (ink receiving unit) of the cap unit 7. In the conveyance direction of the printing medium, a reflection-type optical sensor 30 which will be described later in FIG. 4 is provided on a downstream side of the print head 2. The reflection-type optical sensor 30 is capable of operation in the arrow Y direction by its carriage and has its operation controlled through a motor driver 17.

The conveyance belt 5 is extended on a driving roller connected to a belt driving motor 11 and conveys a printing medium S by rotation/driving of the driving roller. The conveyance belt 5 has its operation controlled through a motor driver 12. On an upstream side of the conveyance belt 5, a charger 13 is provided. The charger 13 brings the printing medium S into close contact with the conveyance belt 5 by charging the conveyance belt 5. The charger 13 has its on/off of conductivity switched through a charger driver 13*a*. A pair of feeding rollers 14 supplies the printing medium S onto the conveyance belt 5. A feeding motor 15 drives/rotates the pair of feeding rollers 14. The feeding motor 15 has its operation controlled through a motor driver 16.

Figure 2:
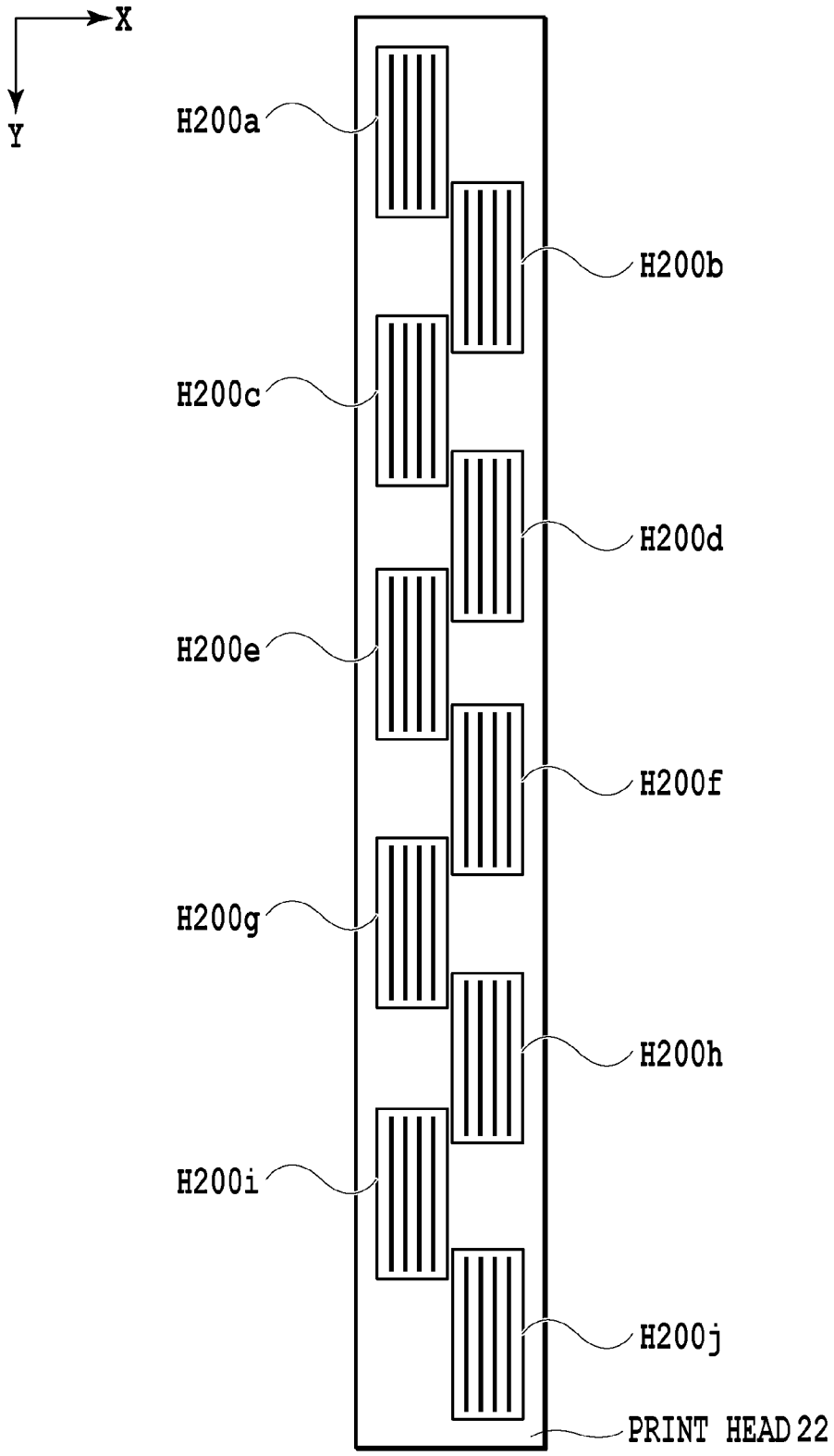
FIG. 2 is a view for explaining a constitution of a print chip on which an ejection port of a print head is disposed.

FIG. 2 is a view for explaining a constitution of a print chip on which an ejection port of the print head 2 is disposed. On a print head 22, for example, ten print chips H200 (H200*a* to H200*j*) each having an effective ejection width of approximately 1 inch and formed of silicon are arranged in a staggered manner on a base substrate (support member). The print chips H200 adjacent to each other in the arrow Y direction are arranged by having a predetermined overlap width in an ejection port arrangement direction (arrow Y direction), respectively, whereby printing without a gap even on a joint between the print chips is made possible.

Figure 3:
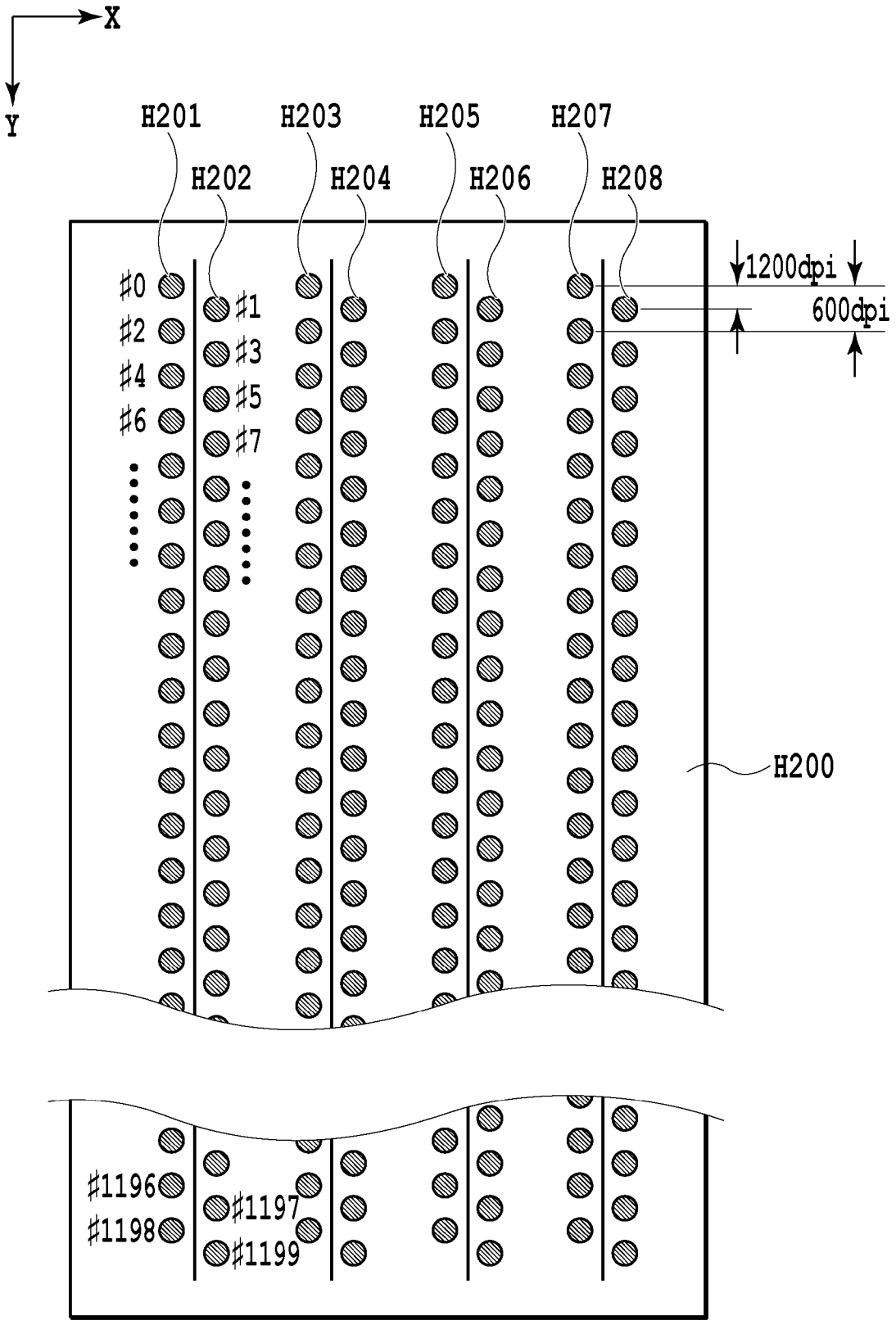
FIG. 3 is a view for particularly explaining ejection port arrangement of the print chip.

FIG. 3 is a view for particularly explaining ejection port arrangement of the print chips H200. On the print chip H200, eight ejection port rows are provided. The ejection port rows H201 and H202 correspond to the black ink (K), the ejection port rows H203 and H204 to the cyan ink (C), the ejection port rows H205 and H206 to the magenta ink (M), and the ejection port rows H207 and H208 to the yellow ink (Y), respectively. An ejection port arrangement pitch of each of the ejection port rows is 600 dpi, respectively, and the two ejection port rows of each color are arranged by being shifted by a half pitch. As a result, printing with resolution at 1200 dpi in the arrow Y direction can be realized for the ink in each color. Moreover, each of the ejection port rows is formed by 600 ejection ports and thus, 1200 ejection ports are provided for the ink in each color. In this Description, an order of the corresponding ejection port rows is set to KCMY as a constitution for explaining the embodiment, but this is not limiting.

FIG. 4 is a schematic view illustrating the reflection-type optical sensor 30. The reflection-type optical sensor 30 is mounted on a carriage (not shown) operable in the arrow Y direction, has a light emitting unit 31 and a light receiving unit 32 and can detect presence or absence of the printing medium S. Light (incident light) 35 emitted from the light emitting unit 31 is reflected by the printing medium S, and reflection light 37 is detected by the light receiving unit 32. A detection signal (analog signal) of the reflection light 37 is transmitted to the control unit 9 (see FIG. 1) through a flexible cable (not shown) and is converted to a digital signal by an A/D converter in the control unit. As this reflection-type optical sensor 30, those with relatively low resolution can be used, whereby cost reduction can be realized.

Figure 5:
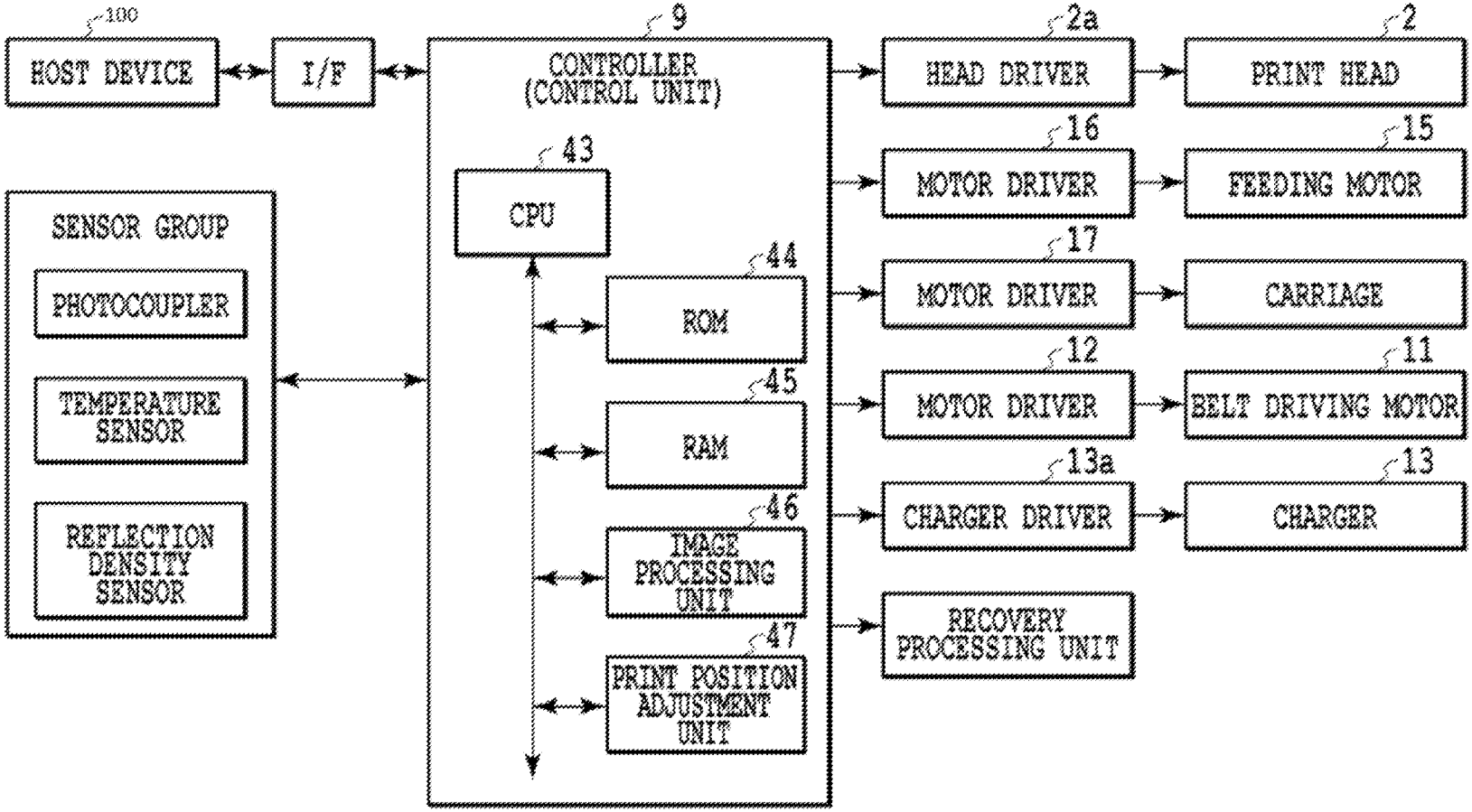
FIG. 5 is a block diagram illustrating a control configuration of the inkjet printing apparatus.

FIG. 5 is a block diagram illustrating a control configuration of the inkjet printing apparatus according to this embodiment and mainly illustrates a detailed configuration of the control unit 9 illustrated in FIG. 1. The controller (control unit) 9 is constituted as its functional configuration having the CPU 43, the ROM 44, the RAM 45, an image processing unit 46, and a print position adjustment unit 47. The CPU 43 integrally controls an operation of the entire printing apparatus of this embodiment. For example, it controls an operation of each unit in accordance with a program stored in the ROM 44. The ROM 44 stores various types of data.

The ROM 44 stores information relating to types of the printing mediums, information relating to the ink, information relating to an environment such as a temperature and humidity, various control programs and the like. The image processing unit 46 executes image processing to image data input from a host device 100 through an interface 100*a*. For example, the image data with a multiple value is quantized for each pixel to image data with an N value, and a dot arrangement pattern corresponding to a gradation value indicated by each of the quantized pixels is assigned. Then, in the end, ejection data (print data) corresponding to each of the ejection port rows is generated. The print position adjustment unit 47 executes print position adjustment processing (registration adjustment processing).

The host device 100 is a supply source of the image data and can be a computer which executes generation, processing and the like of the data, such as images relating to the print or may be a form of a reader part for reading images, or the like. The image data, other commands, status signals and the like are transmitted/received to/from the controller 9 through the interface (I/F) 100*a*. A sensor group is a sensor group for detecting a state of the apparatus and has the reflection-type optical sensor 30 described above in FIG. 4, a photocoupler for detecting a home position, and a temperature sensor provided at an appropriate portion for detecting an environmental temperature and the like.

The head driver 2*a* is a driver for driving the print head 2 in accordance with the print data and the like. The head driver 2*a* includes a shift register for aligning the print data in correspondence with a position of the ejection heater, a latch circuit for latching at an appropriate timing, and a logical circuit element for operating the ejection heater in synchronization with a driving timing signal. Moreover, the head driver 2*a* includes a timing setting unit and the like for setting the driving timing (ejection timing) as appropriate for print position alignment.

The motor driver 16 is a driver for controlling driving of the feeding motor 15 and is used for feeding the printing medium. The motor driver 12 is a driver for controlling driving of the belt driving motor 11 moving the conveyance belt 5 and is used for conveying the printing medium S in the arrow X direction. The motor driver 17 is a driver for controlling driving of a carriage of the reflection-type optical sensor 30. The charger driver 13*a* is used for charging the conveyance belt 5 and for bringing the printing medium S into close contact with the conveyance belt 5.

Figure 6:
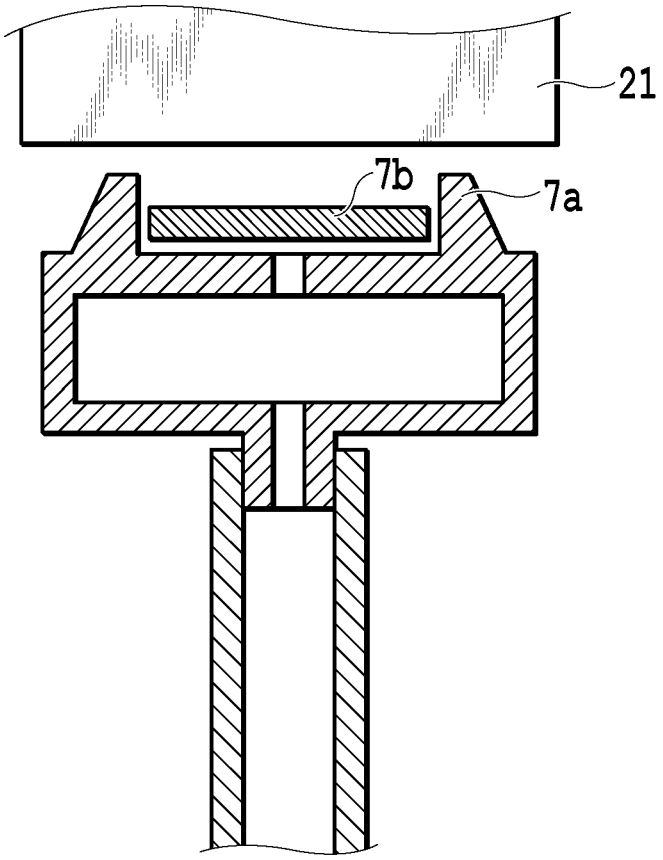
FIG. 6 is a view illustrating a section of a cap unit in the printing apparatus.

FIG. 6 is a view illustrating a section of the cap unit 7 in the printing apparatus to which this embodiment can be applied. The cap unit 7 includes an absorber 7*b* in a cap 7*a* and can prevent mixing of colors and can make favorable a state of first ejection after stop of the driving by ejecting (ejection operation) of the ink from a print head 21 to this absorber 7*b*. The absorber 7*b* can absorb the ink and it is constituted so that the ink absorbed by the absorber 7*b* can be discharged by using a pump or the like.

(Ink Deposition)

Ink deposition refers to a phenomenon in which the ejected ink is accepted by the absorber 7*b* and the ink is deposited on the absorber for the purpose of preventing mixture of colors and of making favorable the state of first ejection after stop of the driving.

(Ink Condensation Degree and Ink Deposition Degree)

Figure 7:
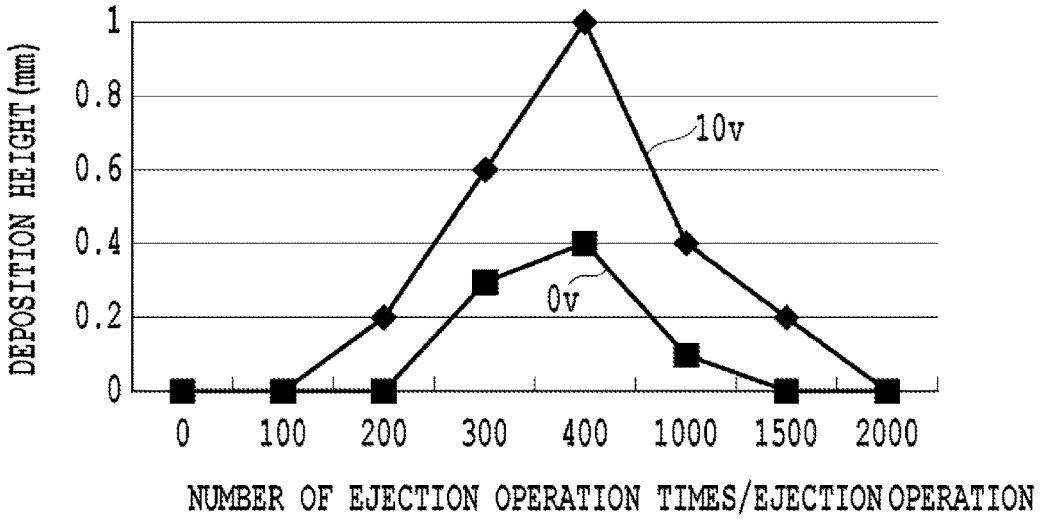
FIG. 7 is an examination result illustrating fluctuation of an ink deposition degree according to the number of ejection operation times.

FIG. 7 is an examination result illustrating fluctuation of an ink deposition degree according to the number of ejection operation times in a case where a condensation degree is different in an ink. This is a graph indicating the number of ejection operation times per ejection operation (the number of times) on a lateral axis and a height (mm) of the ink deposition on a vertical axis. In this Description, the condensation refers to a phenomenon in which the moisture in the ink evaporates and viscosity of the ink increases. A graph 0 v indicates ink non-condensation, while a graph 10 v indicates ink condensation. It is known that ease of the ink deposition differs depending on the condensation degree, and the higher the condensation degree is, the more easily the ink is deposited. Moreover, it is also known that ink deposition tendency differs depending on the number of ejection operation times per ejection operation, and the deposition does not occur within a range from the number of ejection operation times at 0 to the first value, the deposition begins when the first value is exceeded, and the deposition stops again when the second value is exceeded.

In the graph at non-condensation (0 v) in FIG. 7, for example, the deposition does not occur in a case where the number of ejection operation times is from 0 to 200 (first value), while in a case where the number of ejection operation times exceeds 200, the deposition begins. Then, in the case where the number of ejection operation times exceeds 1500 (second value), the deposition stops again. That is caused by an evaporation speed of the ejected ink and an ink absorbing speed of the absorber 7*b* and time until the subsequent ejection operation is performed. Until the number of ejection operation times per ejection operation reaches the first value, the ink absorbing speed of the absorber 7*b* is faster than the evaporation speed of the ejected ink, and in the case where the subsequent ejection operation is performed, the ejection operation is performed in a state where the absorber 7*b* has already absorbed the ink and thus, the deposition does not occur. However, in a case where the first value is exceeded, the ink evaporation speed is faster than the ink absorbing speed, and the ejection operation is performed in a state where the absorber 7*b* has not absorbed the ink, and the ink deposition occurs.

Then, in the case where the second value is exceeded, the ink evaporation speed becomes faster than the ink absorbing speed, and since the ink on the absorber has been absorbed at all times in the case where the subsequent ejection operation is performed, the deposition does not occur again. Moreover, it is also known from the examination result in FIG. 7 that a difference between the first value and the second value becomes larger as the condensation advances. For example, in the non-condensation (0 v) graph in FIG. 7, the first value is 200 and the second value is 1500, while in the condensation (10 v) graph, the first value is 100 and the second value is 2000.

(Method of Obtaining Condensation Degree)

Here, a method of obtaining the condensation degree will be described. In this Description, the condensation refers to a phenomenon in which the moisture in the ink evaporates and viscosity of the ink increases. As the method of obtaining the condensation degree, there are two methods, that is, a method of providing a viscosity sensor or a viscometer for measuring the ink viscosity in the inkjet printing apparatus and a method of calculating the ink viscosity on the basis of information other than viscosity. For example, the information other than the viscosity includes ink remaining vibration, a pump rotation number in an ink supply tube, an ink resistance value, a light receiving amount in printing of a test pattern, an impact distance between a main droplet and a sub droplet, an ink feeding speed, an ink evaporation amount and the like. The ink condensation is obtained by the methods as above. Note that, in the present invention, it is only necessary that the condensation degree of ink is obtained, and its method or a spot for obtaining does not matter.

(Featured Constitution)

A featured constitution of this embodiment will be described below. This embodiment is a form in which the information on the ink condensation degree is obtained each time the ejection operation is performed, and the ink deposition is previously prevented by changing the number of ejection operation times in view of the condensation degree.

By previously preventing the ink deposition, a sequence for dissolving the deposited ink is no longer needed, and the purpose of the ejection operation can be achieved while a discarded ink amount is suppressed as compared with before.

(Method of Determining Number of Ejection Operation Times)

FIG. 8 is a view illustrating a Pv table used in determining the number of ejection operation times which will be performed in this embodiment. A lateral axis indicates a number of deposition preventing ejection operation times P which is the number of ejection operation times required for previously preventing the deposition of the ink, and a vertical axis indicates the ink condensation degree Vn. The number of deposition preventing ejection operation times P has the first value and the second value from the examination result in FIG. 7, and thus, it is further divided into two values, that is, a first value Pf and a second value Ps. The method of determining the first value Pf and the second value Ps differs depending on the types of the ink and the absorber 7*b* to be used and thus, it is determined on the basis of the number of actual ejection operation times which does not cause the deposition through the examination. The first value Pf is a threshold value of the number of ejection operation times until the deposition begins, and the second value Ps is a threshold value of the number of ejection operation times since the deposition stops again, and it is assumed that Pf<Ps is satisfied at all times.

(Number of Ejection Operation Times Changing Sequence)

Figure 9:
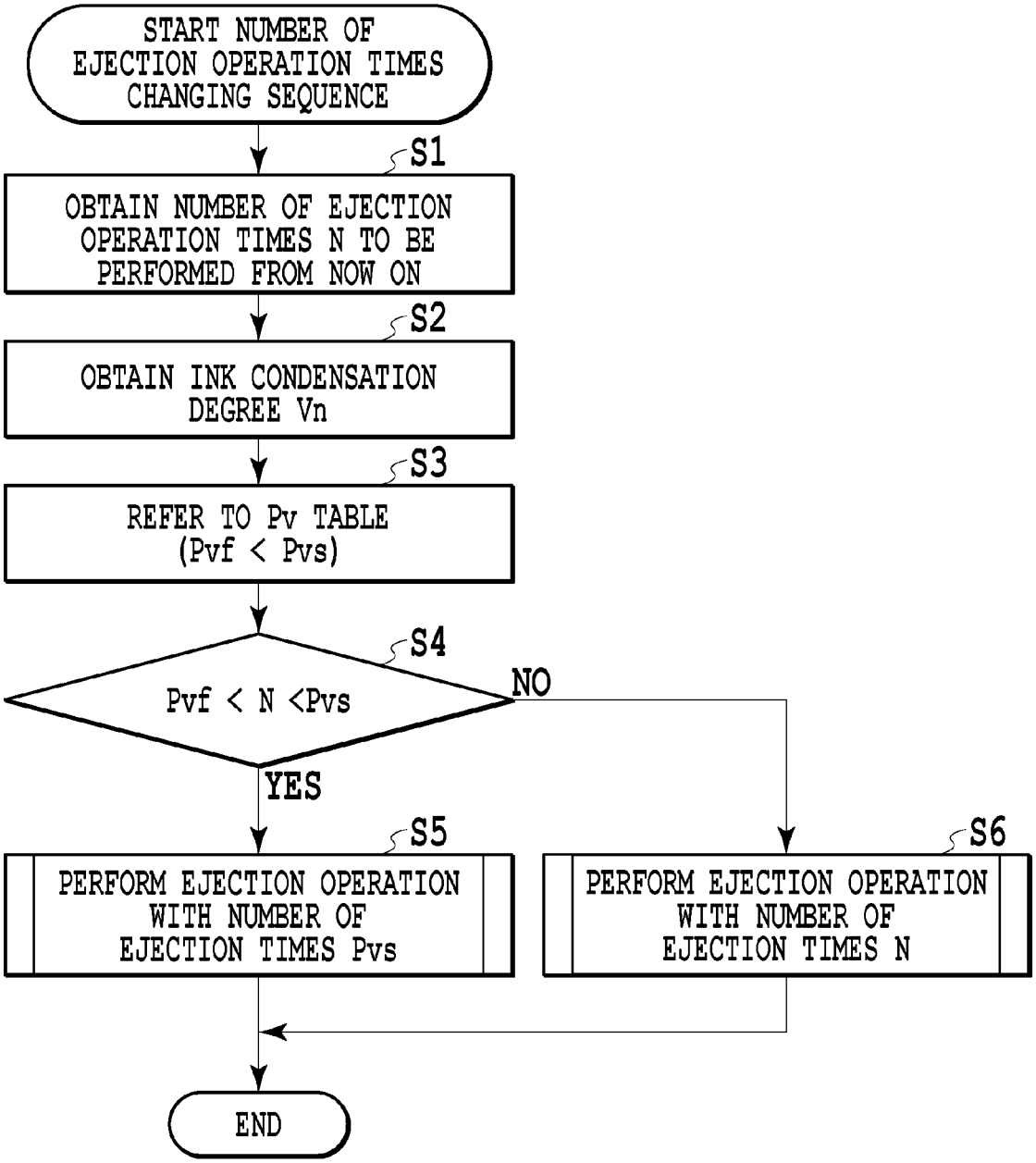
FIG. 9 is a flowchart illustrating a sequence of recovery control.

FIG. 9 is a flowchart illustrating a sequence of the recovery control in the embodiment of the present invention. In this embodiment, in a case where a ejection operation execution flag is set, first, the routine enters the number of ejection operation times changing sequence at the same time, the number of ejection times is changed in accordance with the ink condensation degree and then, the ejection operation is made. Hereinafter, the number of ejection operation times changing sequence will be described by using the flowchart in FIG. 9. In a case where the number of ejection operation times changing sequence is started, the number of ejection operation times N which will be performed from now on is obtained at Step S1, and information indicating the ink condensation degree Vn is obtained at Step S2. Subsequently, at Step S3, the first value (Pvf) and the second value (Pvs) determined in view of the ink condensation degree prepared in advance are referred to. After that, at Step S4, the number of ejection operation times N and the first value (Pvf), the second value (Pvs) are compared on the basis of the number of ejection operation times N which will be performed from now on obtained at Step S1 and the condensation degree V obtained at Step S2. In the case of Pvf<N<Pvs at Step S4, the number of ejection operation times is changed to Pvs, the routine proceeds to Step S5, and the ejection operation is performed with the number of ejection times Pvs. In a case where the number of ejection operation times N is not between the first value (Pvf) and the second value (Pvs) at Step S4, the routine proceeds to Step S6, and the ejection operation is performed with the number of ejection times N.

As described above, the information relating to the ink condensation degree is obtained, and the ejection operation is performed in accordance with the obtained ink condensation degree. As a result, the inkjet printing apparatus and the recovery processing method which can suppress occurrence of the defective ejection and can suppress the wasteful consumption of the ink could be realized.

Second Embodiment

A second embodiment of the present invention will be described below by referring to the drawings. Note that, since a basic constitution of this embodiment is similar to that of the first embodiment, only featured constitutions will be described below.

In this embodiment, a dissolution ejection operation sequence in which a deposition degree of a deposited object is estimated in view of the condensation degree, and in a case where a certain threshold value is exceeded, an ink which is hard to be deposited is ejected so as to dissolve the deposited object is executed. As a result, an ink consumption amount and the discarded ink amount can be suppressed while the deposited object is solved.

(Deposited Amount Counting Method)

FIG. 10 is a view illustrating a Csv table used in counting the ink deposited amount (obtaining a deposited amount) in this embodiment. A lateral axis indicates a number of ejection operation times Sn, a vertical axis indicates an ink condensation degree Vn, and a Csv value according to the number of ejection operation times Sn and the condensation degree Vn is described. In this embodiment, explanation will be made assuming a case where the number of ejection operation times differs depending on the type of the sequence, but this is not necessarily limiting but the number of the ejection operation times may be the same in all the sequences. In that case, a Cv table taking into account only of the condensation degree Vn is used. Since a method of determining a Csv value differs depending on the types of the ink and the absorber to be used, it is determined on the basis of an actual height of the deposited object through the examination.

(Dissolution Ejection Operation Sequence)

Figure 11:
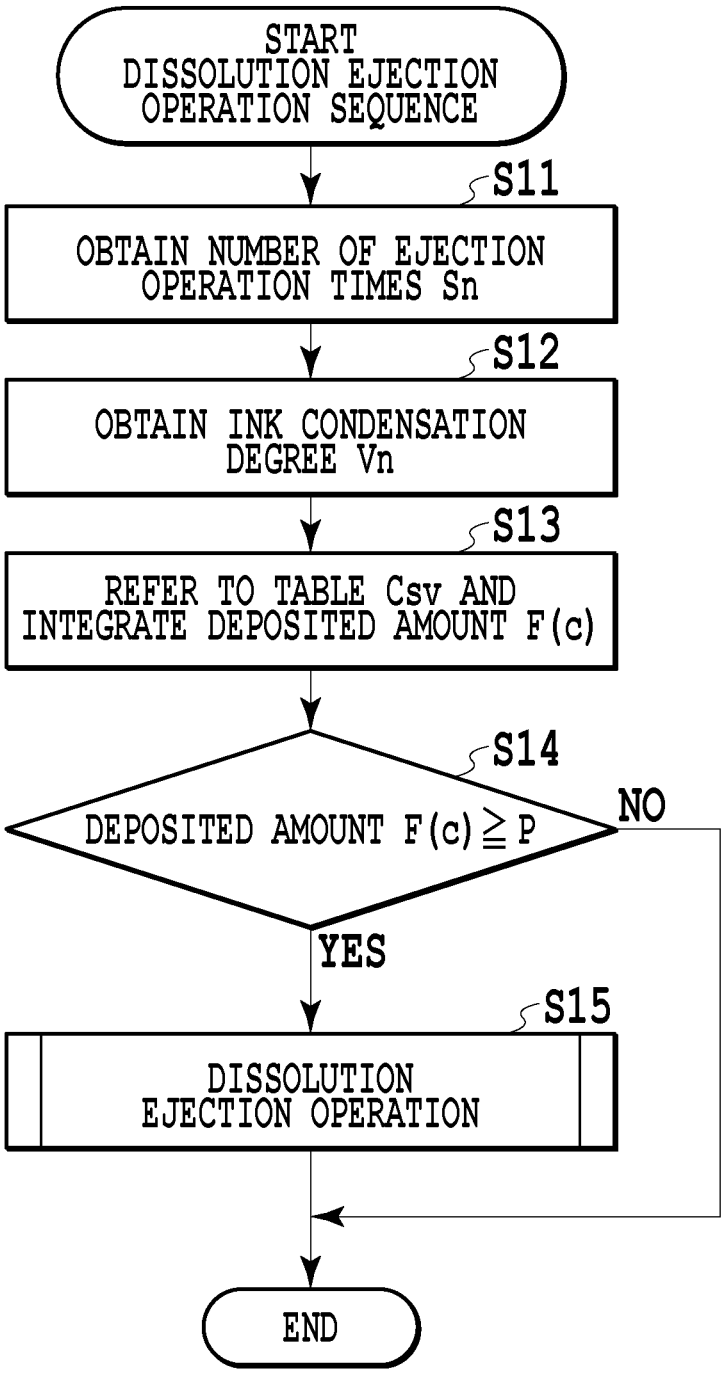
FIG. 11 is a flowchart illustrating a sequence of the recovery control.

FIG. 11 is a flowchart illustrating a sequence of the recovery control in the embodiment of the present invention. Hereinafter, the dissolution ejection operation sequence will be described by using this flowchart. In a case where the dissolution ejection operation sequence is started, the information Sn indicating the number of ejection operation times is obtained at Step S11, and the information Vn indicating the ink condensation degree is obtained at Step S2. Subsequently, at Step S3, a numerical value Csv according to the number of ejection operation times Sn and the condensation degree Vn is added to a deposited amount F(c) by referring to the Csv table (an initial value of the deposited amount F(c) is 0). After that, at Step S4, it is determined whether the deposited amount F(c) calculated at Step S3 is at a threshold value P determined in advance or more. In a case where the deposited amount F(c) is at the threshold value determined in advance or more, the routine proceeds to Step S5, the dissolution ejection operation for ejecting the ink which is hard to be deposited (capable of dissolving the deposited ink) is executed, while in a case where the deposited amount F(c) is smaller than the threshold value P determined in advance, the processing is finished at that time.

As described above, the information on the ink condensation degree is obtained, the deposited amount F(c) is calculated in accordance with the obtained ink condensation degree and is compared with the threshold value, and it is determined whether or not the dissolution ejection operation is to be made. As a result, the inkjet printing apparatus and the recovery processing method which can suppress occurrence of the defective ejection and can suppress the wasteful ink consumption could be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-142526 filed Jul. 20, 2016, which is hereby incorporated by reference wherein in its entirety.

What is claimed is:

1. An inkjet printing apparatus comprising:

a print head configured to perform printing by ejecting ink from an ejection port;

an ink receiving unit configured to receive ink ejected from the print head;

a preliminary discharge unit configured to cause the print head to perform a preliminary discharge operation to the ink receiving unit in response to receiving a preliminary discharge command having a number of preliminary discharges;

an obtaining unit configured to obtain information relating to a condensation degree of ink; and a changing unit configured to change the number of preliminary discharges, in a case where the preliminary discharge command is received, based on a first threshold value determined by the condensation degree of ink obtained by the obtaining unit and a second threshold value that is larger than the first threshold value.

2. The inkjet printing apparatus according to claim 1, further comprising a calculating unit configured to calculate a deposited amount of ink in the ink receiving unit based on the information relating to the condensation degree of ink obtained by the obtaining unit.

3. The inkjet printing apparatus according to claim 2, wherein the preliminary discharge unit causes the print head to perform a dissolution ejection operation in a case where the deposited amount calculated by the calculating unit is larger than a third threshold value.

4. The inkjet printing apparatus according to claim 3, wherein the preliminary discharge unit causes the print head to eject an ink capable of dissolving a deposited ink in the dissolution ejection operation.

5. The inkjet printing apparatus according to claim 1, wherein the ink receiving unit has an absorber capable of absorbing an ink.

6. The inkjet printing apparatus according to claim 1, further comprising a measuring unit configured to measure a condensation degree of ink, wherein the obtaining unit obtains the condensation degree of ink measured by the measuring unit.

7. The inkjet printing apparatus according to claim 1, wherein:

the print head performs printing by ejecting ink onto a printing medium; and the ejection ports are arranged by forming a row over a width of the printing medium.

8. A recovery processing method of an inkjet printing apparatus including a print head configured to perform printing by ejecting ink from an ejection port and an ink receiving unit configured to receive ink ejected from the print head, the method comprising:

a receiving step of receiving a preliminary discharge command having a number of preliminary discharges;

an obtaining step of obtaining information relating to a condensation degree of ink;

a changing step of changing the number of preliminary discharges received in the receiving step based on a first threshold value determined by the condensation degree of ink obtained in the obtaining step and a second threshold value that is larger than the first threshold value; and a preliminary discharge step of causing the print head to perform a preliminary ejection operation by ejecting ink from the print head based on the number of preliminary discharges changed in the changing step.

9. The inkjet printing apparatus according to claim 1, wherein the changing unit does not change the number of preliminary discharges in a case where the number of preliminary discharges is smaller than the first threshold value.

10. The inkjet printing apparatus according to claim 9, wherein the changing unit does not change the number of preliminary discharges in a case where the number of preliminary discharges is larger than the second threshold value.

11. The inkjet printing apparatus according to claim 10, wherein the changing unit changes the number of preliminary discharges to the second threshold value in a case where the number of preliminary discharges is larger than the first threshold value and smaller than the second threshold value.

12. The inkjet printing apparatus according to claim 1, wherein the first threshold value in a case where the condensation degree is higher than a predetermined value is smaller than the first threshold value in a case where the condensation degree is lower than the predetermined value.

13. The inkjet printing apparatus according to claim 12, wherein the second threshold value in a case where the condensation degree is higher than the predetermined value is larger than the second threshold value in a case where the condensation degree is lower than the predetermined value.

* * * * *